United States Patent [19]

Schuder

[11] 4,106,142

[45] Aug. 15, 1978

[54] MATTRESS CONSTRUCTION

[76] Inventor: Paul S. Schuder, Rte. 1, Box 1155, Woodland, Calif. 95695

[21] Appl. No.: 836,717

[22] Filed: Sep. 26, 1977

[51] Int. Cl.[2] ..... A47C 21/00

[52] U.S. Cl. ..... 5/345 R; 5/91; 5/355; 5/361 B

[58] Field of Search ..... 5/91, 317 R, 345, 322, 5/357, 361 R, 361 B, DIG. 2, 355

[56] References Cited

U.S. PATENT DOCUMENTS

| | | | |
|---|---|---|---|
| 2,469,084 | 5/1949 | Schenker | 5/91 |
| 2,543,218 | 2/1951 | Young et al. | 5/345 R |
| 3,323,152 | 6/1967 | Lerman | 5/355 |
| 3,370,306 | 2/1968 | Lovette | 5/327 |
| 3,818,519 | 6/1974 | Schuder | 5/317 R |

*Primary Examiner*—Casmir A. Nunberg
*Attorney, Agent, or Firm*—Lothrop & West

[57] ABSTRACT

A plurality of discrete elongated plates is embedded in a mattress body of resilient foam material. The plates are disposed in at least two parallel horizontal planes with the longitudinal dimension of the plates transverse to the longitudinal dimension of the mattress. The arrangement not only provides comfort to a single sleeper but also minimizes any tendency of the downward displacement induced by the weight of one sleeper to be transferred to an adjacent portion of the mattress, for example, to the portion occupied by another person, thereby enabling both to sleep restfully.

3 Claims, 4 Drawing Figures

FIG-1
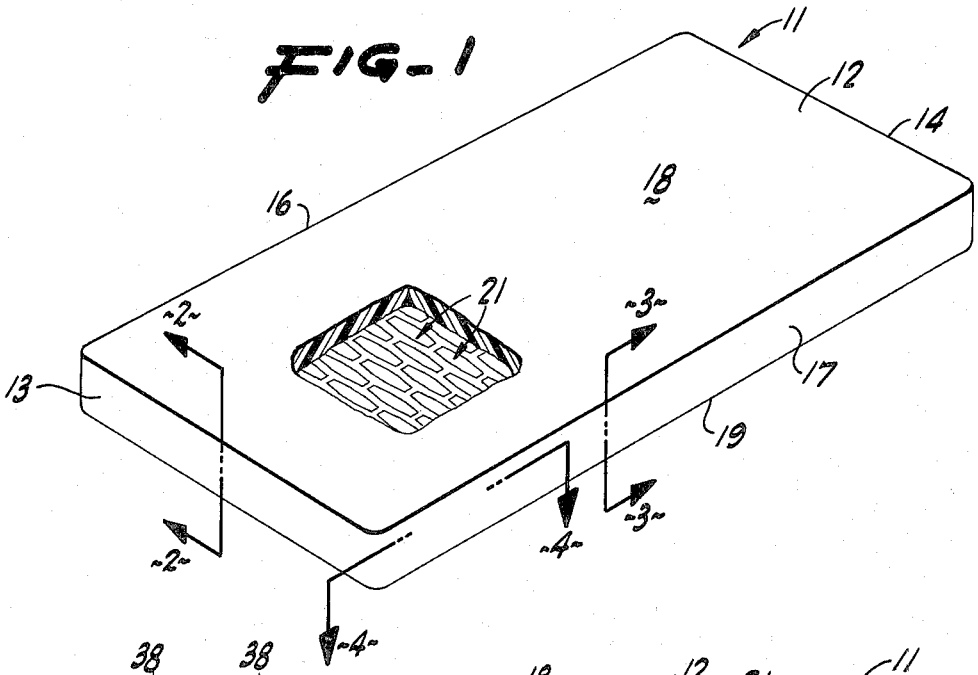
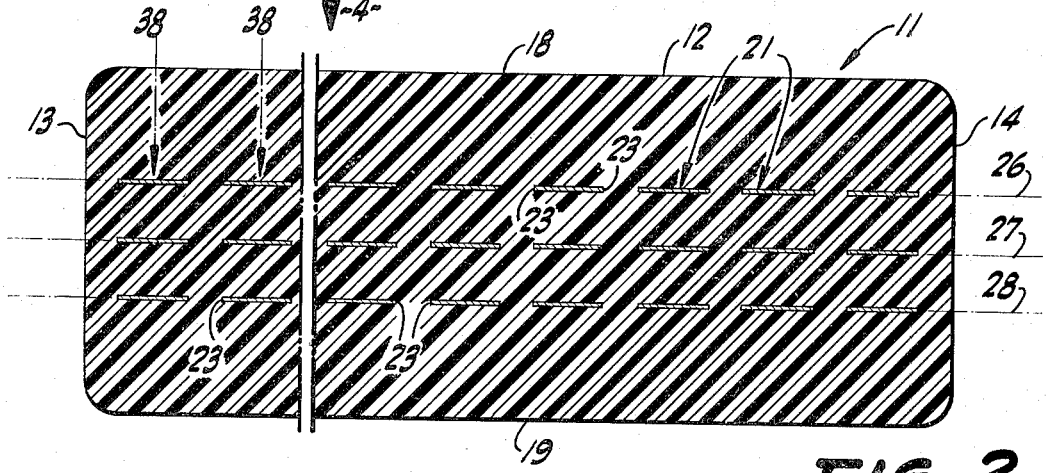
FIG-2
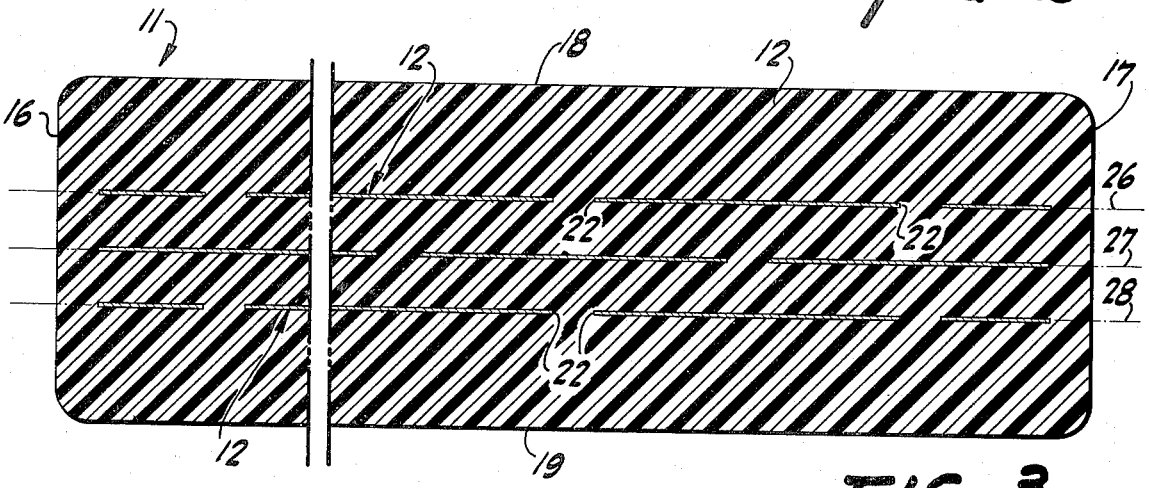
FIG-3

MATTRESS CONSTRUCTION

BACKGROUND OF THE INVENTION

Mattresses of resilient foam material have long been popular owing to their low weight and cost. However, they are generally too soft to provide the support required by many people, especially those with back ailments. If the mattress is made thin in an attempt to reduce the extent of the depression induced by body weight, protruding portions of the sleeper's body, such as the hip bone and elbows, compress the mattress to maximum density and provide an uncomfortable sleep.

Another problem encountered in mattresses generally, not only of the resilient foam type but also the spring variety, is the tendency of the large sag or depression caused by a heavy person to extend to the adjacent portion of the mattress. Should a lighter person also be sleeping on the mattress, the large depression caused by the heavy person tends to make the lighter person roll down the side of the depression. Under such circumstances the lighter person is unable to enjoy a restful sleep.

The prior art is not lacking in disclosures of various types of mattresses endeavoring to overcome the foregoing problems.

Some of the prior art patents have in fact suggested that inserts be interposed between layers of mattresses (such as my U.S. Pat. No. 3,818,519 in which a basket-weave matrix of flat strips is used) to alleviate the problems.

Other have utilized sheets of plywood, particle board, or the like, horizontally sandwiched between layers of foam material, exemplary being I. Young et al U.S. Pat. No. 2,543,218 and S. Lerman U.S. Pat. No. 3,323,152. Such devices minimize sag but lack the comfort afforded by more flexible inserts.

Still others, such as R. R. Upton U.S. Pat. No. 3,319,274, prefer thin corrugated metal sheets inserted between foam layers, with the corrugation channels longitudinally aligned with the long dimension of the mattress. Such mattress construction will not sag appreciably in a longitudinal direction and it also permits the mattress to be rolled up transversely into a compact roll. By the same token, however, the problem of the sag induced by a heavy person and the effect upon an adjacent sleeper is not solved by the corrugated metal insert disclosed in Upton.

SUMMARY OF THE INVENTION

The invention relates generally to improvements in mattress construction and, more particularly, to mattresses of resilient foam material in which inserts in the foam reduce sag and provide increased comfort.

The invention embeds a plurality of discrete elongated plates in a resilient foam mattress body in several vertically spaced, parallel, horizontal planes, or layers. The long axis of the plates is at right angles to the long dimension of the mattress and the plates in adjacent layers are, in plan, arranged in rows with the plates in each row in overlapping relation.

It is an object of the invention to provide a mattress construction which increases the rigidity of the mattress while allowing flexure of the mattress to conform comfortably to the body of the sleeper regardless of the sleeper's weight.

It is another object of the invention to provide a mattress construction in which the tendency of the downward displacement of the mattress caused by the weight of a heavy person to be transferred to the adjacent portion of the mattress is minimized.

It is yet another object of the invention to provide a mattress construction which is not only economical in that it does away with the need for a foundation mattress or base springs but which is also durable and long-lived.

It is a further object of the invention to provide a mattress construction which can be made in various degrees of firmness, thickness, number and size of plates and types of material to fit any need.

Other objects, together with the foregoing, are attained in the embodiment described in the following description and illustrated in the accompanying drawing.

BRIEF DESCRIPTION OF THE DRAWING

FIG. 1 is a perspective view to a reduced scale, of a mattress embodying the present invention, a portion of the foam material being cut away to reveal the top layer of plates;

FIG. 2 is a sectional view taken on the line 2—2 of FIG. 1, a portion being broken away to reduce the extent of the figure;

FIG. 3 is a sectional view section taken on the line 3—3 on FIG. 1, a portion being broken away to reduce the extent of the figure; and, FIG. 4 is a fragmentary section taken on the line 4—4 of FIG. 1.

DESCRIPTION OF THE PREFERRED EMBODIMENT

Figure 4:
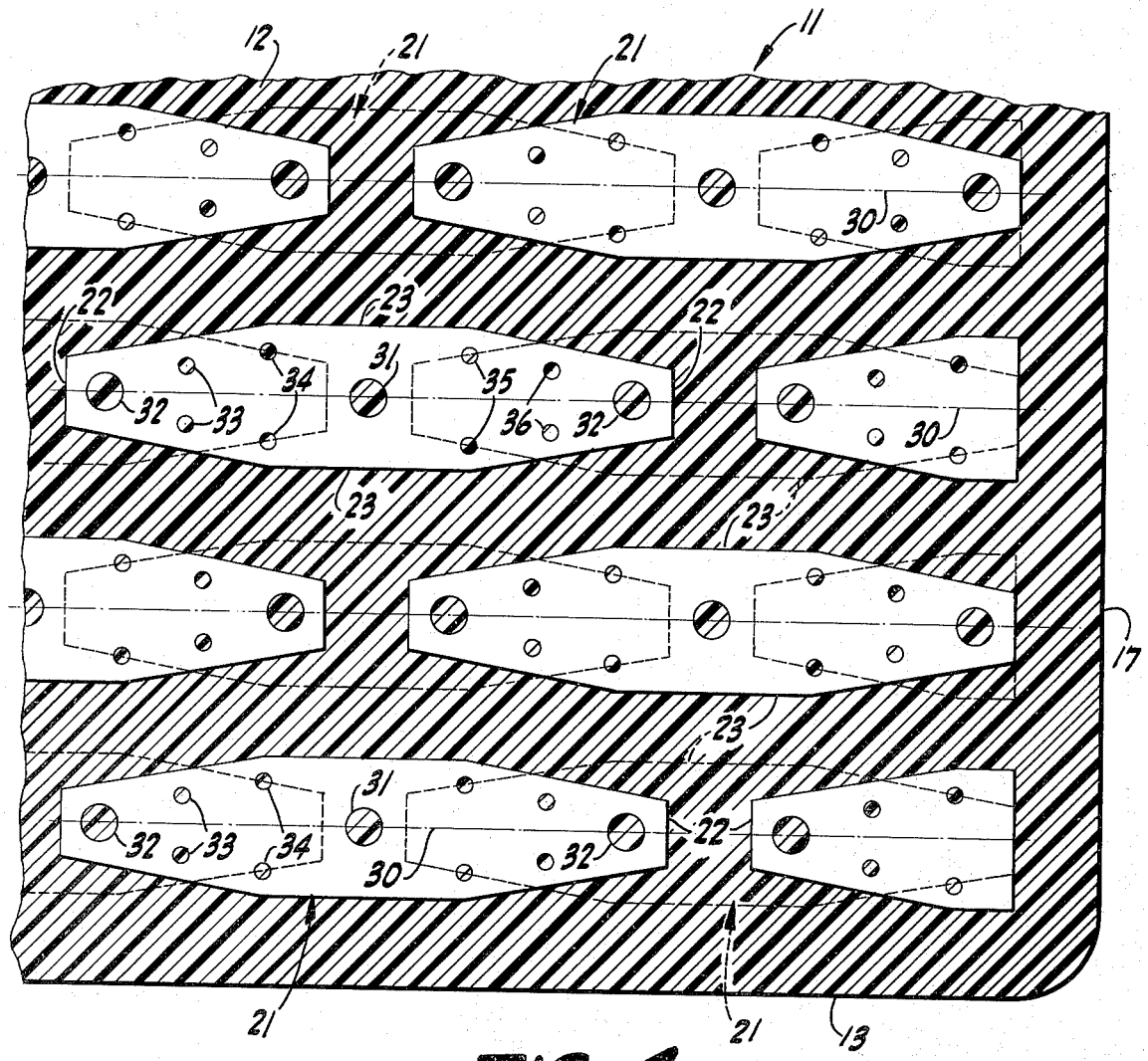

While the mattress structure of the invention is susceptible of numerous physical embodiments, depending upon the environment and requirements of use, at least one of the herein shown and described embodiments has been made, tested and used, and has performed in an eminently satisfactory manner.

With particular reference to FIG. 1 of the drawing, a mattress construction of the invention, generally designated by the reference numeral 11, comprises a rectangular-in-plan body 12 extending longitudinally from one end 13 to the other end 14, transversely from one side 6 to the other side 17 and vertically from top 18 to bottom 19.

The mattress body 12 is preferably constructed of resilient foam material, such as foam rubber, or the like, and is customarily utilized in the horizontal attitude shown.

Embedded in the foam body 12 is a plurality of plates 21, the plates being substantially identical in size and elongated so as to extend between a pair of opposite ends 22 and opposite lateral sides 23.

Preferably, the lateral sides 23 of both end portions of the plates are beveled for approximately one-third of the length of the plate, as appears most clearly in FIG. 4, in order to facilitate, to an appropriate extent, the ability of the plates to tilt somewhat about their longitudinal and transverse axes as weight is applied.

In order to achieve a major object of the invention, namely, providing a mattress which will afford comfort to persons in a wide range of body sizes and weights, the plates are arranged in a carefully predetermined fashion.

First, the plates are disposed in three vertically spaced planes, or layers, namely, an upper layer 26, a middle layer 27 and a lower layer 28, as indicated in FIGS. 2 and 3.

The distance between the top 18 of the mattress and the uppermost plane 26 of the plates 21 is approximately equal to the distance between the uppermost plane 26 and the lowermost plane 28, and to the distance between the lowermost plane 28 and the bottom 19 of the mattress. The mattress body is thus approximately bilaterally symmetrical about the center plane 27 and can be reversed, top for bottom, to provide an equal degree of efficacy and comfort.

As appears most clearly in FIG. 4, each plate is provided along its longitudinal axis 30 with three relatively large openings, namely, a central opening 31 and a pair of end openings 32. A plurality of pairs of relatively small openings 33, 34, 35 and 36 is also symmetrically formed in each plate as shown in FIG. 4. This arrangement of openings not only increases, to a desirable degree the flexibility of the plates but also assists in maintaining the plates in their proper relative position by reason of the intrusion of the foam material through the openings, as shown.

It is especially to be noted that the long axis 30 of each of the plates 21 is at right angles to the long dimension of the mattress body 12; and, as can best be seen in FIGS. 2 and 4, plates are arranged in a plurality of vertical rows 38, with the adjacent side edges 23 in adjacent rows spaced apart about one half the transverse width of a plate, thereby affording the desired flexibility and comfort in the long dimension of the mattress body.

In plan view, as in FIG. 4, and in the direction of the long dimension, as in FIG. 3, the plates in each of the vertical rows 38 are disposed in an overlapping arrangement with the plates in the upper layer 26 in register with the plates in the lower layer 28 but with the plates in the middle layer 27 displaced substantially equal to one half the distance between centers so as to provide the symmetrical pattern shown.

FIG. 4 shows the plates in the upper plane 26 in solid line and the plates in the middle plane 27 in broken line. The plates in the lower plane 28 in FIG. 4 do not appear since they are directly below the upper plates shown in solid line.

As a consequence of the construction disclosed, the plates 21 increase the rigidity of the mattress body 12 but allow a desirable degree of longitudinal as well as lateral flexure for a person of any weight.

A person of relatively light weight might be supported by only the top layer of foam material, i.e. the material located between the top 18 of the mattress and the upper plane 26. In other words, only a small amount, if any, of downward displacement of the upper layer 26 of plates would take place.

A person of medium weight tends not only to compress the top layer of foam but also to displace downwardly at least the subjacent plates in the upper layer 26, and thereby compress the foam material located between the plate layers 26 and 27.

Lastly, a heavy person would perhaps downwardly displace the plates in the upper layer 26, those in the middle layer 27 and even, to some extent, those in the bottom layer 28.

In all cases, however, the row arrangement of plates which obtains in the long dimension of the mattress provides sufficient flexure to afford comfort.

Furthermore, not only does the overlapping pattern of the plates in the respective transverse rows give the proper degree of support to persons of widely varying size and weight but it also minimizes any downward displacement in the vicinity of a heavier person, such as would affect and cause discomfort to another person sleeping on the mattress.

The plates 21 are preferably of a flexible material, such as a suitable "plastic" or lightly tempered metal, so as to flex an amount sufficient to distribute the weight of the sleepers to a comfortable degree but which, at the same time, do not unduly deform nearby plates in the same row owing to the stiffening effect of the overlapping end portions and the positioning effect of the foam material intruding through the openings 31 – 36 in the plates.

It can therefore be seen that I have provided a light, durable mattress construction which affords a most desirable degree of comfort and rest to one or more persons sleeping or resting thereon.

What is claimed is:

1. A mattress construction comprising:

a. a rectangular, normally horizontal, resilient foam material body extending longitudinally between opposite ends, transversely between opposite sides, and vertically between a top surface and a bottom surface;

b. a plurality of discrete elongated upper plates embedded in said body and disposed in a upper, normally horizontal plane located a predetermined distance below said top surface, said upper plates being arranged in a plurality of transversely extending separated upper rows with the long dimension of said upper plates aligned with said upper rows;

c. a plurality of discrete elongated middle plates embedded in said body and disposed in a central, normally horizontal plane located equi-distant between said top surface and said bottom surface, said middle plates being arranged in a plurality of transversely extending separated middle rows with the long dimension of said middle plates aligned with said middle rows, said upper rows being vertically above said middle rows and the end portions of said upper plates being in overlapping relation with respect to the end portions of said middle plates below said upper plates; and, d. a plurality of discrete elongated lower plates embedded in said body and disposed in a lower, normally horizontal plane located a distance above said bottom surface substantially equal in amount to said predetermined distance, said lower plates being arranged in a plurality of transversely extending separated lower rows with the long dimension of said lower plates aligned with said lower rows, said lower plates being in vertical register with said upper plates.

2. A mattress construction as in claim 1 in which said plates are of plastic material.

3. A mattress construction as in claim 2 in which the lateral edges of said end portions are beveled and said plates are formed with a plurality of holes into which the resilient foam material of said body intrudes.

* * * * *